US005596882A

United States Patent [19]

Hutchison et al.

[11] Patent Number: 5,596,882

[45] Date of Patent: Jan. 28, 1997

[54] RECEIVER FOR REFRIGERANT AND METHOD OF MAKING SAME

[75] Inventors: Wayne K. Hutchison, Ingersoll; William N. Eybergen, Dutton; Ken R. Blackman, St. Thomas; Victor A. Phillips, London, all of Canada

[73] Assignee: Eaton Corporation, Cleveland, Ohio

[21] Appl. No.: 402,595

[22] Filed: Mar. 13, 1995

[51] Int. Cl.[6] ..... F25B 43/00

[52] U.S. Cl. ..... 62/503; 29/890.06

[58] Field of Search ..... 62/474, 503, 509, 62/512, 298; 29/890.06, 890.53; 55/192, 463, 387; 210/DIG. 6

[56] References Cited

U.S. PATENT DOCUMENTS 4,768,355 9/1988 Breuhan et al. ..... 62/503
4,994,185 2/1991 Cullen et al. ..... 210/282
5,245,842 9/1993 Searfoss ..... 62/474
5,289,697 3/1994 Hutchison ..... 62/474
5,419,157 5/1995 Kiblawi et al. ..... 62/503
5,435,153 7/1995 Hutchison et al. ..... 62/474

*Primary Examiner*—William Doerrler
*Attorney, Agent, or Firm*—Roger A. Johnston

[57] ABSTRACT

A receiver/drier/filter for refrigerant having an aluminum cannister formed integrally with one end closed and an inlet tube and outlet standpipe extending through ports in the closed end and brazed therein with the external tube ends formed at right angles to facilitate external connection. A center tube is received over and sealed on the standpipe with a desiccant filled basket having a cover plate washer received over the center tube through the open end of the cannister as a subassembly. An aluminum cap is brazed over the open end of the cannister to seal the assembly. Alternatively, the basket and center tube are molded integrally of plastic.

22 Claims, 6 Drawing Sheets

RECEIVER FOR REFRIGERANT AND METHOD OF MAKING SAME

BACKGROUND OF THE INVENTION

The present invention relates to receivers for refrigerant circulated in a refrigeration system and particularly systems of the type employed for vehicle air conditioning. Receivers employed for vehicle air conditioning systems typically include desiccant material for trapping moisture and filter material for preventing recirculation of foreign particles. Receivers of this type have commonly employed a cylindrical or cannister configuration for convenience of manufacture and mounting within the engine compartment of the vehicle for connection in the refrigerant line between the condenser and evaporator.

Heretofore refrigerant receivers for vehicle applications have typically employed a header having the inlet tube and outlet standpipe tube attached thereto with a cannister containing the desiccant and filtering material attached to the header and sealed thereabout. Known refrigerant receivers have been formed of steel or with aluminum headers and cannisters. However, the problems of attaching and sealing the fittings to the header or cannister have proven formidable in vehicle mass production, particularly where the tubes are required to be formed at right angles upon entering and exiting the receiver. Receiver driers having a header generally have a flat top configuration on which ports are machined for connection of the tubes by such techniques as connecting blocks which have proven to be costly for mass production. This has been particularly troublesome for mass production where it is desired to have quick connect fittings for the tubes for attachment to the receiver.

Thus it has long been desired to find a way or means of constructing a refrigerant receiver which is low in manufacturing cost, easily assembled and light in weight and which eliminates the need for machining of tube attachment ports in a header block.

SUMMARY OF THE INVENTION

It is an object of the present invention to provide a light weight easily assembled refrigerant receiver which has a closed end cup shaped cannister with an inlet tube and a standpipe outlet tube connected through ports formed in the closed end. It is another object to provide such a receiver with a center tube received over the standpipe and having a perforated basket containing desiccant and filter material received over the center tube and closed with a cover plate. It is another object to provide such a receiver having the open end of the cannister is sealed with a cap. It is another object to have such a receiver with the cannister and cap formed of aluminum material with the tubes and cap braised thereon. In one embodiment the center tube is formed of aluminum and has the upper end flared outwardly over the basket cover plate with a resilient seal sealing the flared portion against the standpipe. The center tube is flanged on its lower end to retain the basket and the center tube retained on the standpipe by frictional engagement.

In another embodiment, the center tube is formed of plastic material and retains the cover on the basket by snap-locking; and, the center tube and basket are retained on the standpipe by frictional engagement.

In another embodiment, the center tube is formed of plastic and has an internal annular rib engaging a groove in the standpipe for retaining the basket in place on the standpipe.

In another embodiment the basket and center tube are formed integrally of plastic with an annular rib formed inside the center tube and engaging a groove on the standpipe.

In another embodiment the basket and center tube are formed integrally and are retained on the standpipe by frictional engagement of a separate fastener.

The unique construction of the receiver of the present invention permits the desiccant filled basket and perforated cover plate to be assembled through the open end of the cannister and retained on the standpipe and the cannister sealed by a cap. The cannister and cap are formed of aluminum and the cap is attached to the cannister preferably by weldment.

Figure 6:
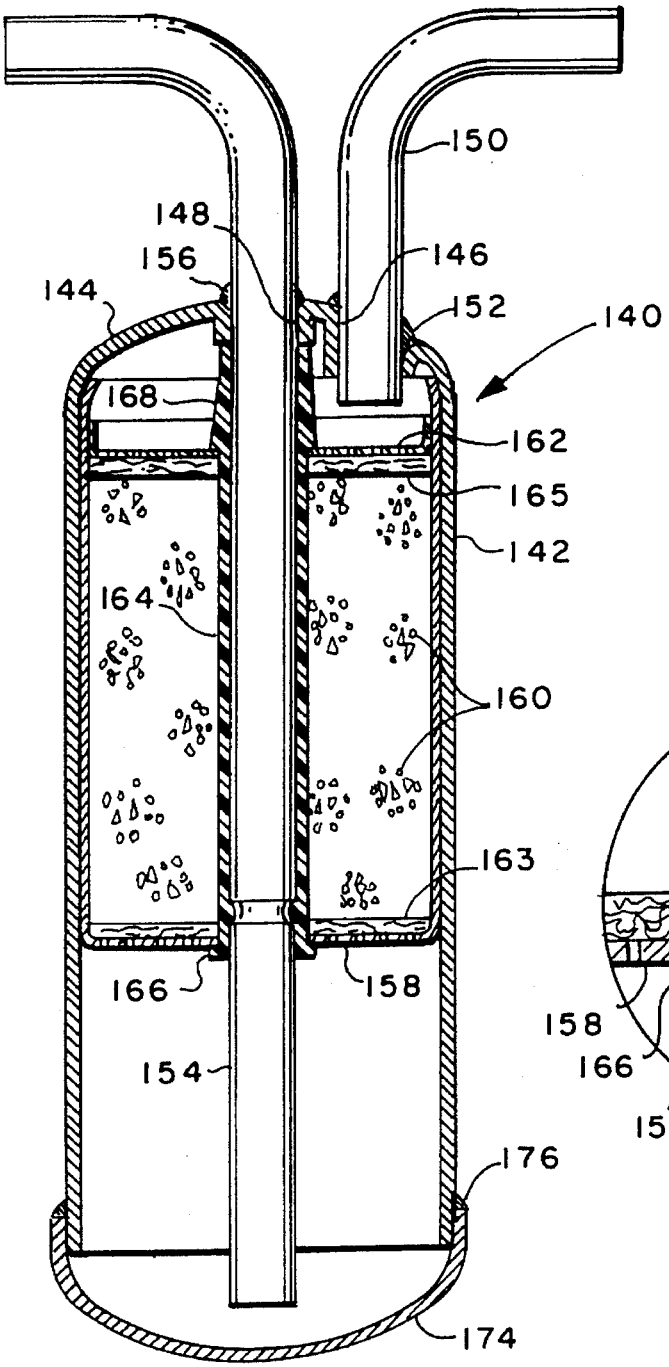
FIG. 6 is another embodiment of a receiver in accordance with the invention employing a plastic center tube.
Figure 8:
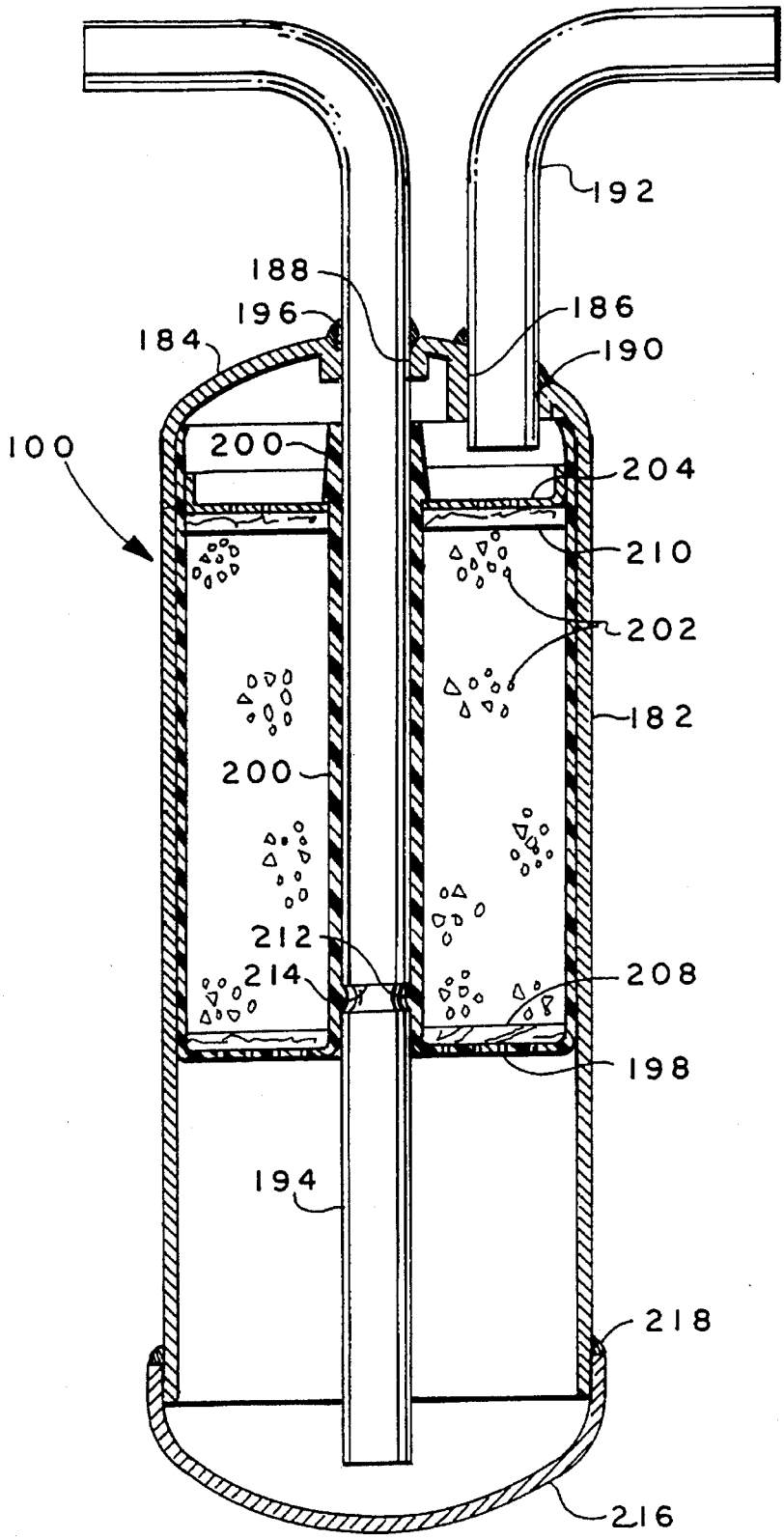
Figure 9:
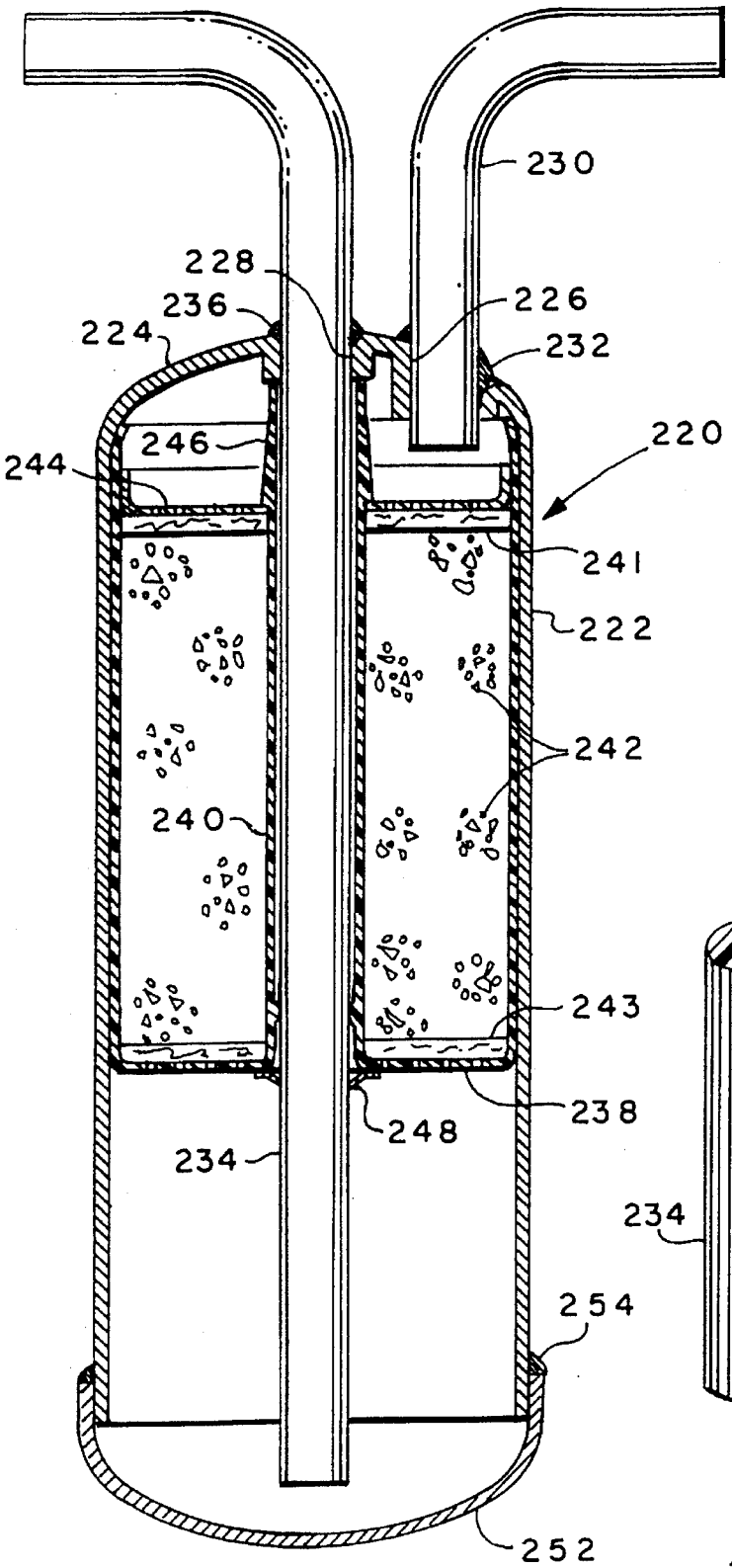

FIG, 7 is an enlarged view of a portion of FIG. 6;

FIG. 8 is a cross-sectional view of another embodiment of the invention employing an integral basket and center tube; and, FIG. 9 is an alternate embodiment employing an integral plastic basket and center tube.

Figure 10:
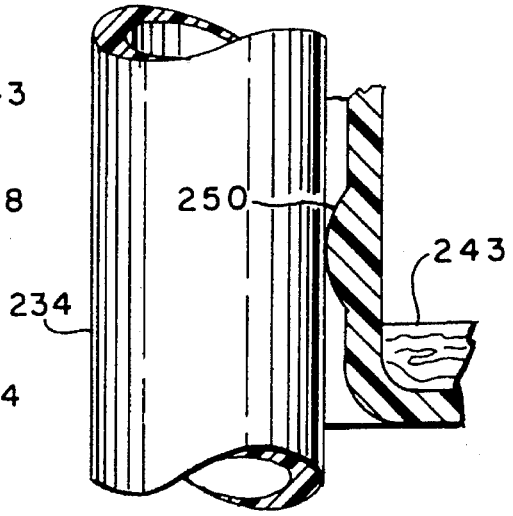

FIG. 10 is an enlarged view of a rib used for frictional engagement.

DETAILED DESCRIPTION

Figure 1:
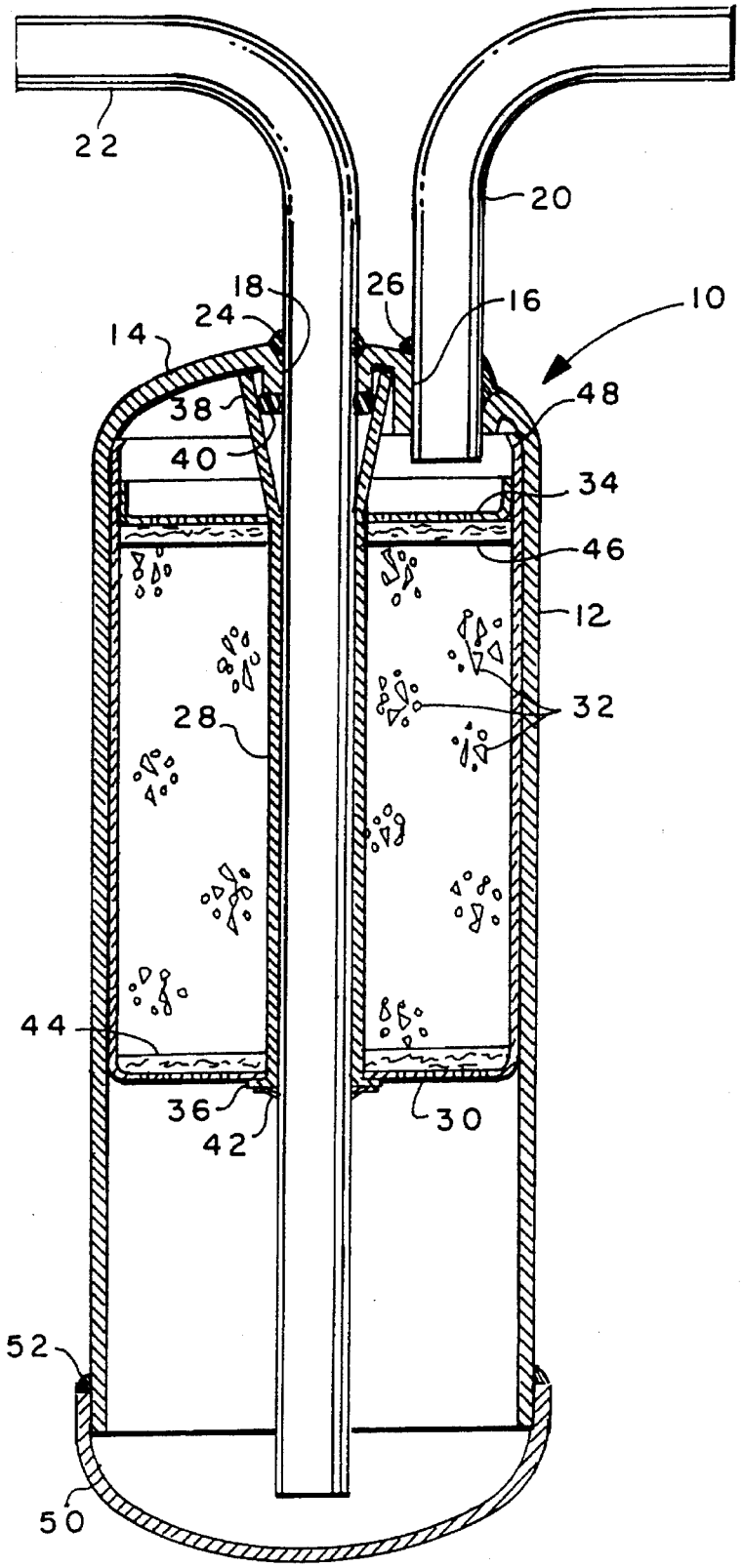
FIG. 1 is a cross-section of an all metal embodiment of the invention.

Referring to FIG. 1, an all metal embodiment of the invention is indicated generally at 10 and has a preferably deep drawn lightweight metal cannister 12 preferably formed of aluminum with an integrally formed closed end 14.

Referring to FIG. 1, the aluminum cannister 12 has a closed end 14 and has an inlet port 16 formed therein which is spaced from a central outlet port 18 also formed through the closed end of the cannister. Inlet port 16 has sealed therein preferably by brazing the generally right angled inlet tube 20; and, the outlet port 18 has similarly disposed and sealed therein preferably by brazing an aluminum outlet standpipe tube 22 which extends downwardly the length of the cannister 12; and, the exterior or upper end of tube 22 is preferably disposed at right angles to the interior portion to facilitate external attachment thereto. It will be understood that the cannister 12 and tubes 20,22 form a subassembly after performing of the brazing which is denoted by reference numerals 24,26 in FIG. 1.

In the embodiment of FIG. 1, the preferably aluminum center tube 28 is received through an aperture formed in the flat bottom of a perforated basket 30 which is filled with desiccant material 32 and closed with a perforated cover washer or annular plate 34 received over the desiccant material. In the embodiment of FIG. 1, the lower end of center tube 28 has an outwardly extending flange 36 formed thereon which is registered against the undersurface of the basket 30. The upper end of the tube 28 extends through a central aperture formed in the cover plate 34 and the tube is flared outwardly to retain the cover plate 34 in place over the desiccant material as denoted by reference numeral 38. A resilient seal ring 40 is installed between the flared center tube end 38 and the standpipe 28 adjacent the port 18 to seal the center tube about the standpipe. The center tube and desiccant filled basket are assembled as a sub-asssembly over and retained on the standpipe by frictional engagement which in the embodiment of FIG. 1 preferably comprises a fastener 42 frictionally engaging the standpipe and registered against the flange 36 of the center tube.

In the presently preferred practice, the basket 30 has a layer of fine mesh or preferably fibrous filter material 44 adjacent the perforated bottom of the basket 30 and also adjacent the perforated cover plate 34 as denoted by reference numeral 46. In the present practice of the invention, the upper rim of the basket is wedged against the undersurface of the closed end 14 of the cannister to effect a slight crimping as denoted by reference numeral 48 to provide a seal for preventing refrigerant entering the inlet tube 20 from passing between the basket 30 and the inner surface of the cannister 12.

Upon completion of the assembly of the desiccant filled basket 30 onto the standpipe 22, a relatively thin-wall formed cap or closure 50 is received over the lower end of the cannister 12 and attached thereto by weldment, preferably aluminum brazing as denoted by reference numeral 52. In the present practice of the invention the cannister is sufficiently longer than the basket 30 to permit the brazing 52 without overheating the desiccant material in the basket 30.

Figure 2:
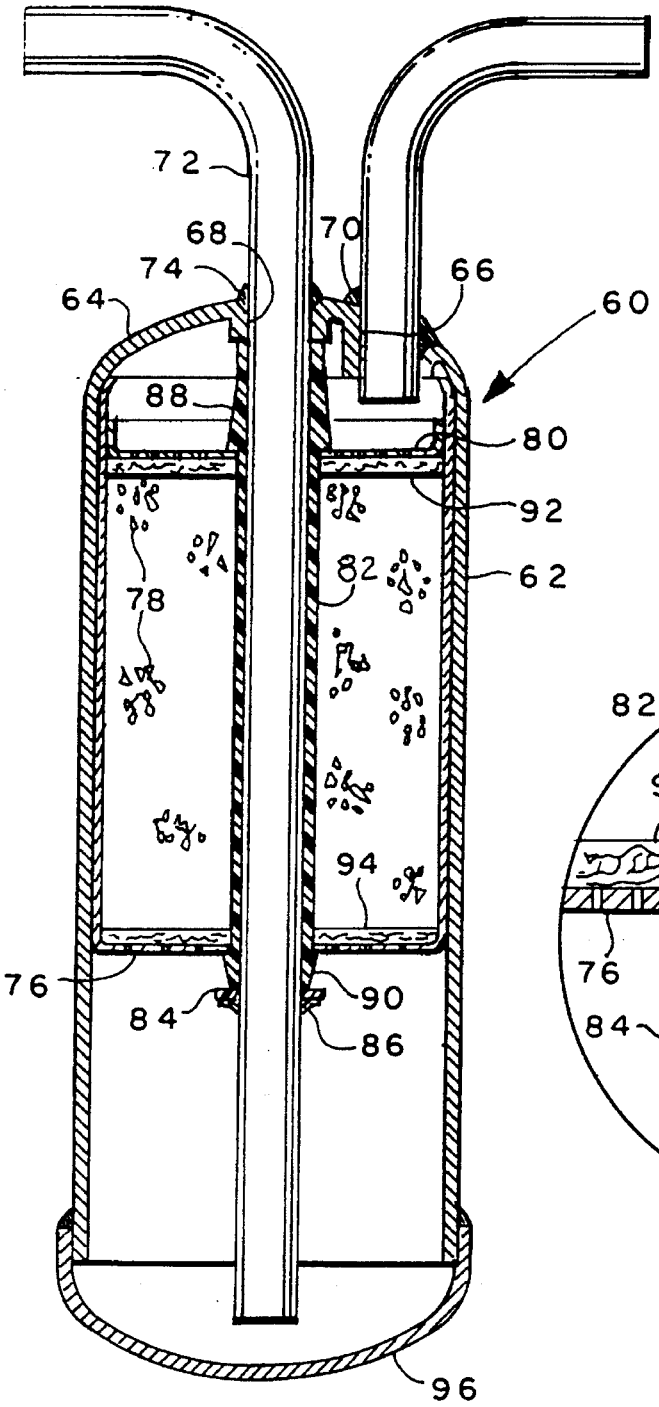
FIG. 2 is a cross-section of the invention employing a plastic center tube.
Figure 3:
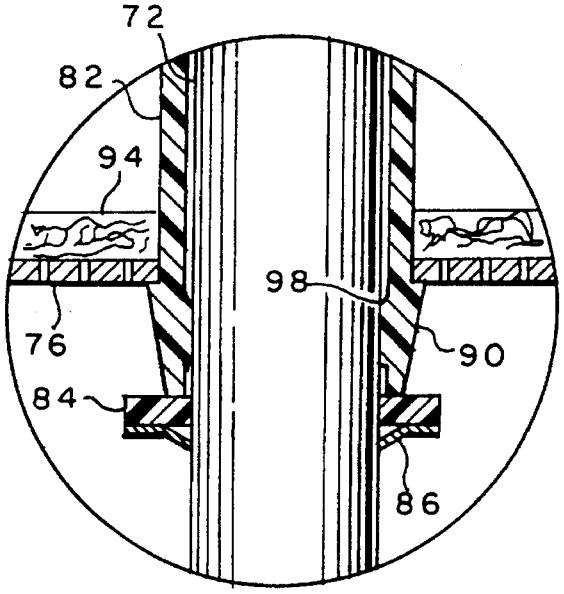
FIG. 3 is an enlarged view of a portion of FIG. 2.

Referring to FIGS. 2 and 3, another embodiment of the invention is indicated generally at 60 and has a cannister 62 formed with a closed upper end 64 with an inlet port 66 formed therethrough and which is spaced from a centrally located outlet port 68 also formed therethrough.

An inlet tube having a generally right angle configuration has one end thereof secured in the inlet port 66 and sealed therein preferably by brazing as denoted at reference numeral 70. A standpipe having a generally right angle configuration at its external or upper end as denoted by reference numeral 72 is received through the outlet port 68 extending downwardly into the cannister and is secured therein preferably by brazing as denoted by reference numeral 74.

A generally cylindrical basket or cup having a perforated flat bottom 76 is filled with desiccant material 78 and covered with a perforated washer or cover plate 80 and received over a center tube 82. The subassembly of the basket, cover plate and center tube is then received over the standpipe 72 through the open end of the cannister 62 and retained thereon by any suitable expedient such as washer 84 and retainer 86 which frictionally engages the surface of the standpipe.

In the presently preferred practice the embodiment of FIG. 2 employs a plastic center tube 82 which has snap-locking surfaces such as barbs 88,90 provided on the ends thereof which serve to retain the basket 76 and cover plate 80 in position thereon. In the presently preferred practice of the invention, a layer of filter material is disposed adjacent the undersurface of cover plate 80 and the perforated bottom of the basket 76 as denoted by reference numerals 92,94 in FIGS. 2 and 3.

With the basket 76 retained in the cannister on center tube 82, a relatively thin-walled cap or closure 96 is formed and secured over the lower end of the cannister 62 preferably by weldment. It will be understood that the cannister is sufficient length that the weldment is located a distance from the basket to permit the welding without damaging the desiccant material from the heat of welding. The embodiment of FIGS. 2 and 3 thus provides a simple construction and easy to assemble receiver which permits the snap together of the basket subassembly on the center tube prior to insertion in the cannister.

Additionally, an annular seal rib 98 is formed on the inner periphery of the center tube 82 adjacent the lower end thereof which rib 98 frictionally engages the outer periphery of standpipe 72 to provide a seal between the center tube and the standpipe to prevent bypass flow around the desiccant material.

Figure 4:
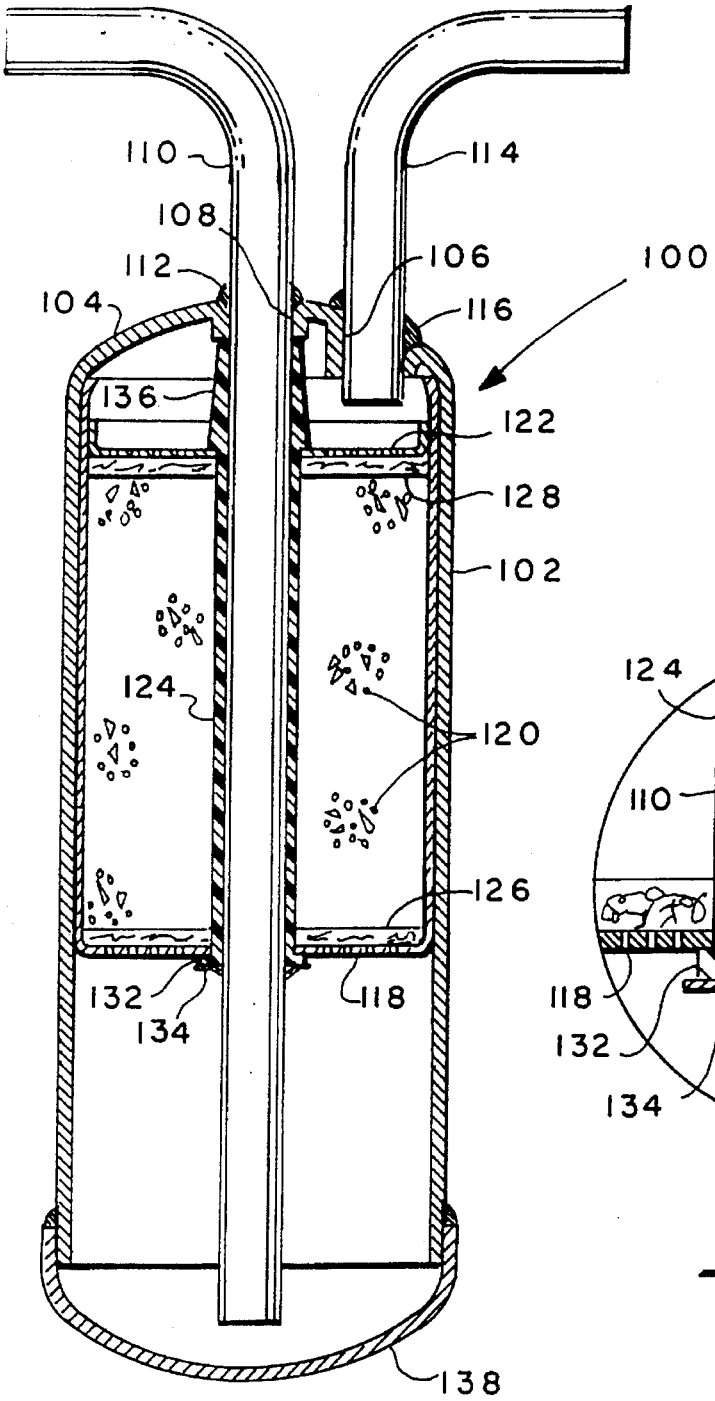
FIG. 4 is an alternate version of the embodiment of FIG. 2.
Figure 5:
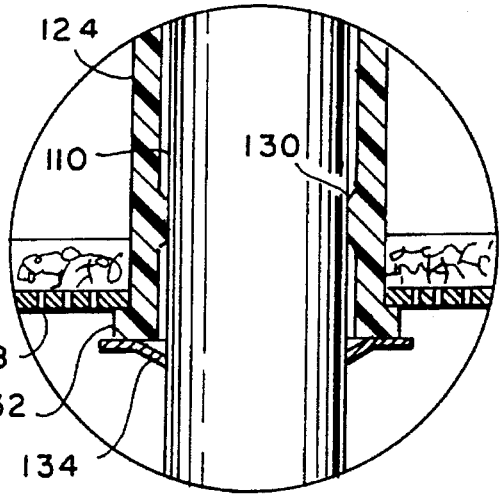
FIG. 5 is an enlarged view of a portion of FIG. 4.

Referring to FIGS. 4 and 5 another embodiment is illustrated which comprises a modification of the embodiment of FIGS. 2 and 3. The receiver assembly of FIG. 4 is indicated generally at 100 and has a cylindrical tubular cannister 102 with a closed end 104 formed integrally therewith, preferably from aluminum material. The closed end 104 has therein an inlet port 106 spaced from a centrally disposed outlet port 108. A standpipe tube 110 is received in outlet port 108 and extends outwardly therefrom in a fight angled configuration and is secured in the port and sealed therein preferably by weldment such as brazing denoted by reference numeral 112. Similarly, an inlet tube 114 having a generally right angled configuration is received in inlet port 106 and secured and sealed therein preferably by weldment 116.

A cylindrical basket having a perforated, generally flat closed end or bottom 118 is filled with desiccant material 120 and the upper end thereof covered with a perforated washer or cover plate 122 and received over a preferably plastic center tube 124 forming a subassembly which is inserted through the open end of cannister 102 over standpipe 110. The basket 118 preferably has a layer of filter material 126 disposed adjacent the bottom of the basket; and, preferably a layer of filter material 128 is also disposed adjacent the undersurface of the cover washer 122.

An annular sealing rib 130 is formed about the inner periphery of the center tube 124 adjacent the lower end thereof; and, the rib 130 frictionally engages the outer periphery of the standpipe 110 to provide a seal thereabout for preventing refrigerant entering the inlet pipe 114 from bypassing the desiccant material 120. The center tube 124 has a radially outwardly extending flange 132 formed on the lower end thereof which registers against the undersurface of basket 118. A retaining washer 134 which frictionally engages the surface of the standpipe 110 registers against the end face of flange 132 to retain the center tube and basket thereon.

In the embodiment of FIG. 4, the upper end of the center tube 124 has a snap-locking retaining surface such as barb 136 formed thereon for retaining the cover 122 in position thereon. Upon completion of the installation of the basket and center tube in the cannister 102, a generally thin-walled cap or closure 138 is formed and received over the open end of the cannister 102 and secured and sealed thereon preferably by weldment. The embodiment of FIG. 4 thus employs an integrally formed flange on the plastic center tube to register against the undersurface of the basket 118 and eliminates the need for the washer employed in the embodiment of FIG. 2.

Figure 7:
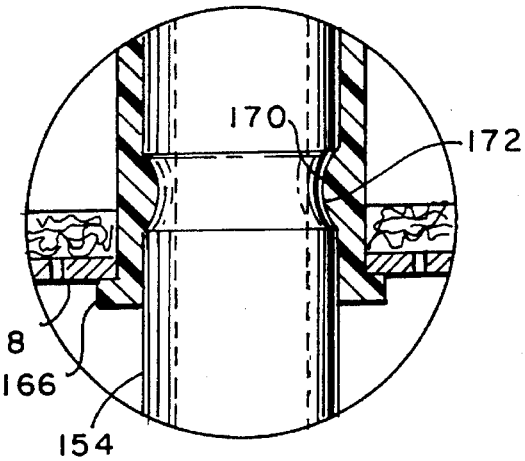

Referring to FIGS. 6 and 7, another embodiment of the invention is illustrated generally at 140 and has a tubular cannister 142 preferably of aluminum material with an integrally formed closed end 144 having an inlet port 146 formed therethrough which is spaced from a centrally disposed outlet port 148 formed through the closed end 144. An inlet tube 150 having a generally right angle configuration has one end thereof inserted into port 146 and sealed and secured therein by weldment such as brazing denoted by reference numeral 52. Similarly, a standpipe 154 is received through outlet port 148 and secured and sealed therein preferably by weldment such as brazing denoted by reference numeral 156. The lower end of standpipe 154 extends downwardly into the cannister for the length thereof from the closed end 144 of the cannister and the upper external end is also formed at generally right angles to the downwardly extending portion of the standpipe.

A generally thin-walled cylindrical basket 158 having a perforated flat bottom is filled with desiccant material 160 covered with a perforated cover washer 162 with a center tube 164 preferably formed of plastic material received through an aperture in the bottom 158 of the basket and through the cover washer 162.

The center tube 164 has a radially outwardly extending flange 166 formed on the lower end thereof which flange registers against the underside of the basket 158 locating the basket on the center tube. The upper end of the center tube has a barb 168 formed thereon for retaining the cover washer 162 in position over the desiccant. The subassembly of the basket, desiccant, center tube and cover washer is then assembled through the open end of the cannister 142 with the open upper rim of the basket wedged against the undersurface of the closed end 144 of the cannister. The center tube has an annular rib 170 formed on the inner periphery thereof adjacent the flange 166; and, rib 170 engages an annular groove 172 formed in the standpipe for snaplocking the center tube in position on the standpipe.

The lower end of the cannister is closed by a relatively thin-wall formed cap or closure 174 which is received over the end of the cannister and secured and sealed thereto preferably by weldment such as brazing as denoted by reference numeral 176.

Referring to FIG. 8, another embodiment of the invention is indicated generally at 180 and has a relatively thin-wall tubular cannister 182 with an integrally formed closed end 184, the cannister preferably being formed of aluminum material. The closed end 184 has formed therethrough an inlet port 186 which is spaced from a centrally disposed outlet port 188 formed therethrough. The inlet port 186 has received therethrough and secured and sealed therein by weldment 190 such as brazing one end of an inlet tube 192 which extends outwardly from the closed end 184 at generally right angles. A standpipe 194 is received through the outlet port 188 and extends downwardly the length of the cannister 182; and, the standpipe is secured and sealed in the port 188 preferably by weldment such as brazing with the upper end thereof extending externally of the cannister formed generally at right angles to the lower end.

A generally thin-wall cylindrical basket having a perforated bottom 198 has a center tube 200 formed integrally therewith. The basket and integrally formed center tube are formed of plastic material in the presently preferred practice. The basket 198 is filled with desiccant material 202 and a perforated cover plate or washer 204 is received thereover. In the embodiment of FIG. 8, the cover washer 204 is retained over the center tube and desiccant by snap-locking over a barb 206 formed integrally with the center tube. If desired, a layer of filter material 208 is disposed adjacent the perforated bottom 198. Similarly, a layer of filter material 210 may be disposed adjacent the undersurface of the cover 204.

The basket 198 with desiccant and cover plate 204 has the center tube 200 assembled through the open end of the cannister 182 over standpipe 194 and upwardly into the cannister with the open rim of the basket wedged in the underside of the closed end 184. The center tube 200 is retained on standpipe 194 by an annular rib 212 formed on the inner periphery of the standpipe which engages a groove 214 formed in the standpipe. The cannister is closed at its lower end by a cap or closure 216 received thereover and secured and sealed thereto preferably by weldment 218. The embodiment of FIG. 8 thus provides an integral one piece basket and center tube formed of plastic material which is readily assembled into the open end of the cannister and snap-locked onto the standpipe as an integral subassembly. The cannister is then closed by attachment of the cap 216.

Referring to FIG. 9, another embodiment of the invention is indicated generally at 220 and has a generally tubular cannister formed with a relatively thin-wall and preferably of aluminum material and which has an integrally formed closed end 224. The closed end 224 has an inlet port 226 formed therein spaced from a centrally located outlet port 220 formed therethrough. Inlet port 226 has inserted therein one end of a generally right angle configured inlet tube 230 which end is secured and sealed in the port 226 preferably by weldment such as brazing denoted 232. Outlet port 228 has received therethrough a standpipe 234 which extends downwardly to the opposite end of the cannister 222 with the portion of the standpipe extending upwardly and externally of the closed end 224 being formed in a right angle configuration with respect to the downwardly extending portion. The standpipe 234 is secured and sealed in the port 228 preferably by weldment such as brazing denoted 236.

The assembly 220 has an integrally formed basket with a perforated generally flat bottom 238 and center tube 240. The basket 238 is filled with desiccant material 242 and covered by a perforated cover washer or plate received over the upper end of the center tube 240. The center tube has a snap-locking surface such as barb 246 formed on the upper end thereof over which the cover plate 244 is snap-locked and retained thereon. The subassembly of the basket with desiccant therein and the cover plate is then inserted in the lower open end of the cannister over the standpipe 234 and retained thereon by a washer clip 248 which frictionally engages the surface of the standpipe 234. The upper end or open rim of the basket 238 is wedged against the undersurface of the closed end 224 of the cannister forming a crimped edge for providing a seal to prevent refrigerant entering inlet tube 230 from bypassing the desiccant material.

Referring to FIG. 10, an annular rib 250 is formed on the inner periphery of the center tube 240; and, the rib frictionally engages the outer periphery of the standpipe 234 to provide a seal and prevent bypass of refrigerant between the center tube and the standpipe. The embodiment of FIG. 9 thus provides an integral center tube and basket similar to the embodiment of FIG. 8; however, the embodiment of FIG. 9 does not require the forming of a groove in the standpipe. A cap or closure 252 is received over and closes and seals the open end of the cannister preferably by weldment 254.

The present invention thus provides a unique, simplified and easy to manufacture, relatively low cost receiver/drier/filter for refrigerant and is particularly suitable for installation in vehicle air conditioning systems. The assembly of the present invention employs permanently attached inlet and outlet tubes having a right angle configuration for facilitating exterior attachment thereto in close quarters. The construction of the receiver/drier/filter of the present invention utilizes an all-aluminum shell and tube construction with the interior desiccant containing basket formed as a subassembly which is assembled over the outlet standpipe tube. The cannister is formed with a spun or deep drawn construction having an integrally formed closed end with ports into which the attachment tubes are brazed; and, the cannister is closed and sealed by an aluminum cap brazed over the cannister after installation of the desiccant basket.

Although the invention has hereinabove been described with respect to the illustrated embodiments, it will be understood that the invention is capable of modification and variation and is limited only by the following claims.

We claim:

1. A refrigerant receiver assembly comprising:

(a) a tubular canister having an integrally formed closed end and an open end, with an inlet and outlet port formed in the closed end;

(b) an inlet tube received in said inlet port and sealed therein;

(c) a standpipe received in said outlet port and sealed therein;

(d) a cup or basket having the closed end perforated and containing desiccant having a tube received therethrough, said cup having a perforated cover plate received over said tube and closing the open end of said basket thereby forming a sub-assembly;

(e) said tube and sub-assembly received over said standpipe and having means engaging said standpipe operative to retain said cup on said standpipe; and, (f) a cap or closure secured over the open end of said canister and sealed thereon.

2. The assembly defined in claim 1, wherein said cannister, said inlet tube, said standpipe and said cap are formed of aluminum and said seals comprise weldment.

3. The assembly defined in claim 1, wherein said cup has the open rim thereof wedged into contact with the closed end of said cannister.

4. The assembly defined in claim 1, wherein said center tube is formed of plastic material.

5. The assembly defined in claim 1, wherein said cup contains a layer of filter material adjacent said perforated end and a layer of filter material adjacent said closure plate.

6. The assembly defined in claim 1, wherein said center tube has integrally formed portion thereof sealing about said standpipe.

7. The assembly defined in claim 1, wherein said center tube is integrally formed with said cup.

8. A method of making a refrigerant receiver assembly comprising:

(a) forming a tubular canister having an integrally formed closed end and forming an inlet and outlet port in the closed end;

(b) sealing an inlet tube in said inlet port and sealing an outlet standpipe in said outlet port;

(c) forming a perforated cup and perforating the closed end and forming an aperture in the closed end thereof and inserting a tube through said aperture and filling said cup with desiccant and assembling a perforated cover over said tube and closing said cup;

(d) assembling said tube and said cup over said standpipe through the open end of said canister and sealing said tube on said standpipe; and, (e) sealing a cap closure or closure over the open end of said cup.

9. The method defined in claim 8, wherein said step of assembling includes wedging the rim of said cup in the closed end of said cannister.

10. The method defined in claim 8, wherein said step of assembling includes frictionally engaging said standpipe.

11. The method defined in claim 8, wherein said step of sealing said inlet, outlet and cap includes welding.

12. A method of making a refrigerant receiver assembly comprising:

(a) forming a tubular canister having an integral closed end and forming an inlet and outlet port therein;

(b) sealing an inlet tube in said inlet port and sealing an outlet standpipe in said outlet port;

(c) forming a cup with a center tube integrally formed with the bottom of the cup and filling said cup with desiccant and covering said cup with a perforated closure washer and forming a sub-assembly;

(d) inserting said sub-assembly in the open end of said canister and sliding said center tube over said standpipe and sealing said center tube on said standpipe; and, (e) forming a closure and sealing same over the open end of said canister.

13. The method defined in claim 12, wherein said step of assembling includes wedging the rim of said cup in the closed end of said cannister.

14. The method defined in claim 12, wherein said step of forming a cup includes forming a perforated cup of plastic material.

15. The method defined in claim 12, wherein (a) said step of forming said cup includes forming a perforated cup of plastic material; and, (b) said step of covering said cup includes snap-locking a closure washer over the standpipe.

16. The method defined in claim 12, wherein said step of forming a cup includes forming a cup and integral standpipe of plastic material; and, said step of sealing said center tube on said standpipe includes forming an annular sealing rib on the interior of said center tube.

17. The method defined in claim 12, wherein said step of assembling said center tube over said standpipe includes frictionally engaging said standpipe.

18. The assembly defined in claim 1, wherein said tube is centrally disposed in said basket.

19. The assembly defined in claim 1, wherein said cap is snap locked over said tube for forming said sub-assembly.

20. A receiver/filter/drier assembly comprising:

(a) a tubular canister having an integrally formed closed end and an open end, with an inlet and outlet port formed in the closed end;

(b) an inlet tube received in said inlet port and sealed therein;

(c) a standpipe extending generally the length of said canister received in said outlet port and sealed therein;

(d) a tube received over said standpipe in closely fitting arrangement;

(e) a cup having the closed end thereof perforated and having a central aperture, said cup aperture having a center tube received therethrough and extending the length of said cup;

(f) desiccant material disposed in said cup and perforated cover means closing said cup thereby forming a cup sub-assembly wherein said center tube and subassembly are received over said standpipe; and, (g) a closure header disposed over the open end of said canister and sealed thereon.

21. The assembly defined in claim 20, wherein said center tube is sealed over said standpipe.

22. The assembly defined in claim 20, further comprising means frictionally engaging said standpipe for returning said sub-assembly thereon.

* * * * *